US009049971B2

(12) United States Patent
Andrews

(10) Patent No.: US 9,049,971 B2
(45) Date of Patent: Jun. 9, 2015

(54) VACUUM CLEANING SYSTEMS AND METHODS WITH INTEGRAL VACUUM ASSISTED HOSE STORAGE SYSTEM

(71) Applicant: Tiger Tool International Incorporated, Abbotsford (CA)

(72) Inventor: Michael Andrews, Bellingham, WA (US)

(73) Assignee: Tiger Tool International Incorporated, Abbotsford (CA)

( * ) Notice: Subject to any disclaimer, the term of this patent is extended or adjusted under 35 U.S.C. 154(b) by 116 days.

(21) Appl. No.: 13/842,714

(22) Filed: Mar. 15, 2013

(65) Prior Publication Data

US 2014/0259517 A1 Sep. 18, 2014

(51) Int. Cl.
*A47L 9/00* (2006.01)
*A47L 5/38* (2006.01)

(52) U.S. Cl.
CPC ..... *A47L 9/0036* (2013.01); *Y10T 29/49826* (2013.01); *A47L 5/38* (2013.01); *A47L 9/0009* (2013.01)

(58) Field of Classification Search
CPC ..... A47L 9/009
USPC ..... 15/314, 315, 323; 137/355.16
IPC ..... A47L 9/00
See application file for complete search history.

(56) References Cited

U.S. PATENT DOCUMENTS

| | | | |
|---|---|---|---|
| 2,953,806 | A | 9/1960 | Walker |
| 3,027,588 | A | 4/1962 | Bierstock |
| 3,353,996 | A | 11/1967 | Hamrick |
| 3,520,725 | A | 7/1970 | Hamrick |
| 3,568,240 | A | 3/1971 | Hamrick |
| 4,050,113 | A | 9/1977 | Wright et al. |
| 5,402,551 | A | 4/1995 | Workhoven et al. |
| 5,526,842 | A | 6/1996 | Christensen |
| 5,740,582 | A | 4/1998 | Harrelson, II |
| 6,382,241 | B1 | 5/2002 | Setrum |
| 6,427,284 | B1 | 8/2002 | Harrelson, II et al. |
| 7,010,829 | B2 | 3/2006 | Harman et al. |
| 7,322,070 | B2 | 1/2008 | Zimmerle et al. |
| 7,343,640 | B1 | 3/2008 | Robertson |
| 7,549,448 | B2 | 6/2009 | Ragner |
| 8,001,650 | B2 | 8/2011 | Trotter |
| 2005/0022329 | A1 | 2/2005 | Harman et al. |
| 2009/0188073 | A1 | 7/2009 | Gabric et al. |
| 2011/0041282 | A1 | 2/2011 | Smith et al. |
| 2011/0119860 | A1 | 5/2011 | Marcil et al. |

FOREIGN PATENT DOCUMENTS

| | | |
|---|---|---|
| WO | 2013142992 | 10/2013 |

OTHER PUBLICATIONS

International Searching Authority, ISR PCT/US2014/019635, Jun. 23, 2014, 11 pages.

*Primary Examiner* — David Redding
(74) *Attorney, Agent, or Firm* — Michael R. Schacht; Schacht Law Office, Inc.

(57) ABSTRACT

A storage system for a vacuum cleaning system has a hose storage structure defining a storage chamber having a storage chamber inlet port and a storage chamber outlet operatively connected to the common chamber operatively connected to a vacuum. The storage chamber defines a chamber cross-sectional area. The hose end carrier defines a carrier cross-sectional area, where the carrier cross-sectional area is slightly less than the chamber cross-sectional area. The hose member defines a hose cross-sectional area, where the hose member cross-sectional area is sized and dimension with respect to the carrier cross-sectional area to facilitate movement of the hose member along the storage chamber.

20 Claims, 15 Drawing Sheets

VACUUM CLEANING SYSTEMS AND METHODS WITH INTEGRAL VACUUM ASSISTED HOSE STORAGE SYSTEM

TECHNICAL FIELD

The present invention relates to vacuum cleaning systems and methods and, more specifically, to vacuum cleaning systems having a vacuum assisted hose storage system for a detachable vacuum hose.

BACKGROUND

Residential vacuum cleaning systems are manufactured in two basic types: portable and stationary. In the context of the present application, the term "stationary" will be used to refer to a vacuum cleaning system that does not have wheels and/or normally intended to be moved around during and between uses. That being said, many stationary vacuum cleaning system may be rendered portable by, for example, placing an ordinarily stationary vacuum cleaning system on a wheeled cart.

The present invention is of most significance when applied to stationary vacuum cleaning systems in which a hose is attached to the vacuum system during use and detached from the vacuum system and stored between uses. However, the principles of the present invention may be applied to stationary or mobile vacuum cleaning systems that require storage of a hose between uses.

The length of the vacuum hose determines the cleaning area that may be serviced by a stationary vacuum cleaning system. Other factors being equal, an increase in the length of the vacuum hose (hereinafter also "the hose") increases the size of the cleaning area. Accordingly, stationary vacuum cleaning systems are typically provided with relatively long hose.

The use of relatively long hose creates the need to store the hose when not in use. One method of storing vacuum hoses is to retract the hose into an elongate storage chamber of sufficient length to store the entire length of the hose when the hose is not in use. To facilitate the insertion of the hose into the elongate chamber, a vacuum or motorized mechanical drive system may be applied to the hose itself such that a retraction force is applied to the hose that causes the hose to retract into the elongate chamber.

The need exists for vacuum cleaning system having improved hose storage systems and methods for storing the hose when not in use.

SUMMARY

The present invention may be embodied as a vacuum cleaning system comprising a vacuum system, a hose assembly, and a hose storage system. The vacuum system comprises a vacuum assembly, an inlet structure defining a vacuum inlet port and a common chamber, and a debris chamber structure defining a debris chamber. Operation of the vacuum assembly draws air through the vacuum inlet port, the common chamber, and the debris chamber. The hose assembly comprises a hose member and a hose end carrier, where the hose assembly is adapted to be detachably attached to the vacuum inlet port. The hose storage system comprises a hose storage structure defining a storage chamber having a storage chamber inlet port and a storage chamber outlet operatively connected to the common chamber. The storage chamber defines a chamber cross-sectional area. The hose end carrier defines a carrier cross-sectional area, where the carrier cross-sectional area is slightly less than the chamber cross-sectional area. The hose member defines a hose cross-sectional area, where the hose member cross-sectional area is sized and dimension with respect to the carrier cross-sectional area to facilitate movement of the hose member along the storage chamber.

The present invention may also be embodied as a vacuum cleaning system comprising a vacuum system, a hose assembly, and a hose storage system. The vacuum system comprises vacuum assembly, an inlet structure defining a vacuum inlet port and a common chamber, and a debris chamber structure defining a debris chamber. Operation of the vacuum assembly draws air through the vacuum inlet port, the common chamber, and the debris chamber. The hose assembly adapted to be detachably attached to the vacuum inlet port. The hose storage system comprising a hose storage structure defining a storage chamber having a storage chamber inlet port and a storage chamber outlet operatively connected to the common chamber. The hose storage structure comprises at least first, second, and third parts assembled to define first and second portions of the storage chamber. The first and second portions vertically are spaced from each other.

The present invention may also be embodied as a method of storing a hose member for a vacuum system comprising the following steps. A storage chamber is defined. The storage chamber has a storage chamber inlet port, a storage chamber outlet operatively connected to the common chamber, and at least one turn portion. A hose end carrier defining a carrier cross-sectional area is provided. The carrier cross-sectional area of the hose end carrier is slightly less than a chamber cross-sectional area of the storage chamber. A hose member cross-sectional area of the hose member is sized and dimension with respect to the carrier cross-sectional area to facilitate movement of the hose member along the storage chamber. A hose assembly is formed by securing the hose end carrier on the hose member. The hose assembly is displaced along the storage chamber such that the hose end carrier pivots at the at least one turn portion of the storage chamber.

DETAILED DESCRIPTION

Figure 1:
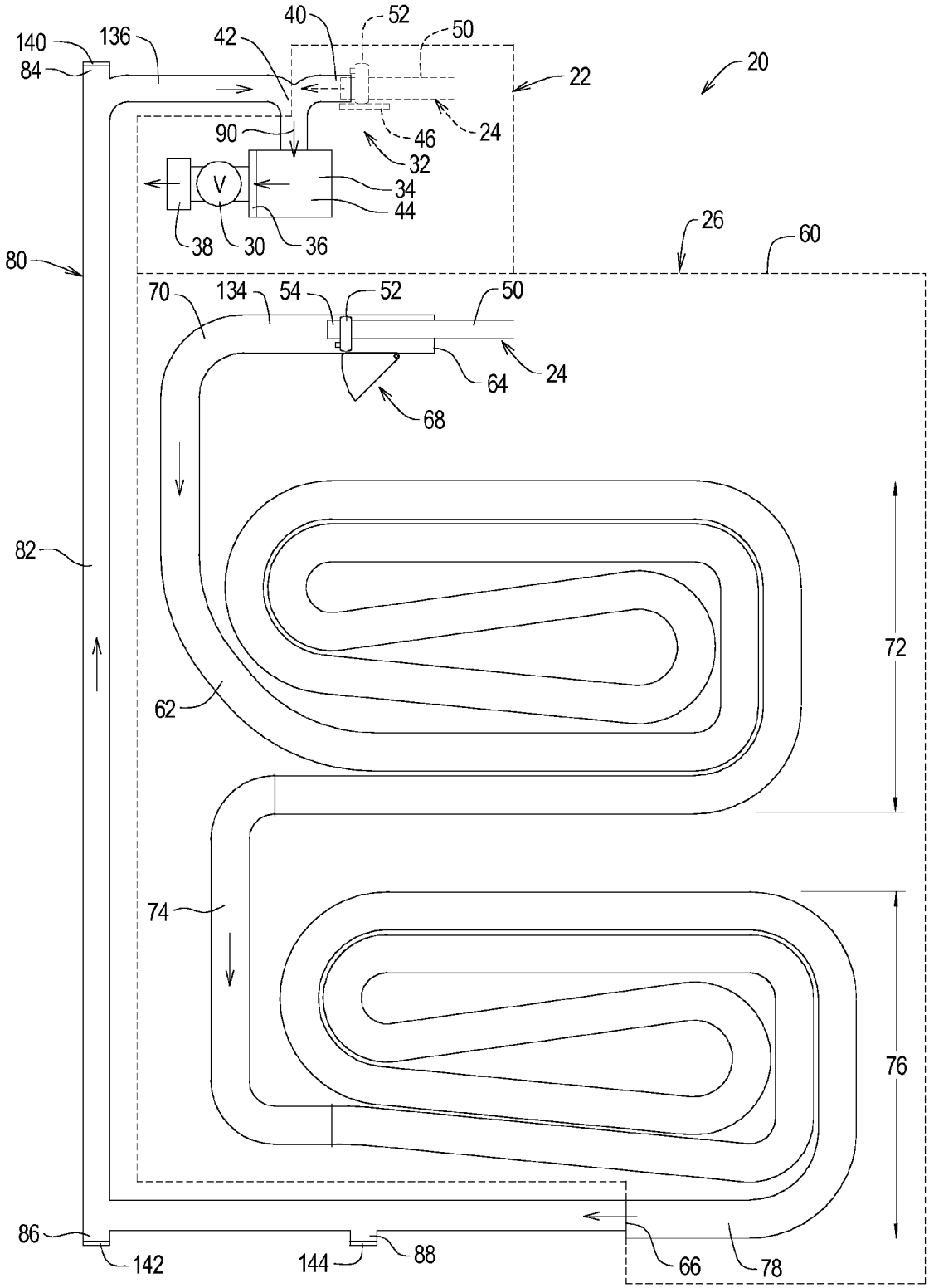
FIG. 1 is a schematic view of a first example vacuum cleaning system of the present invention.
Figure 3:
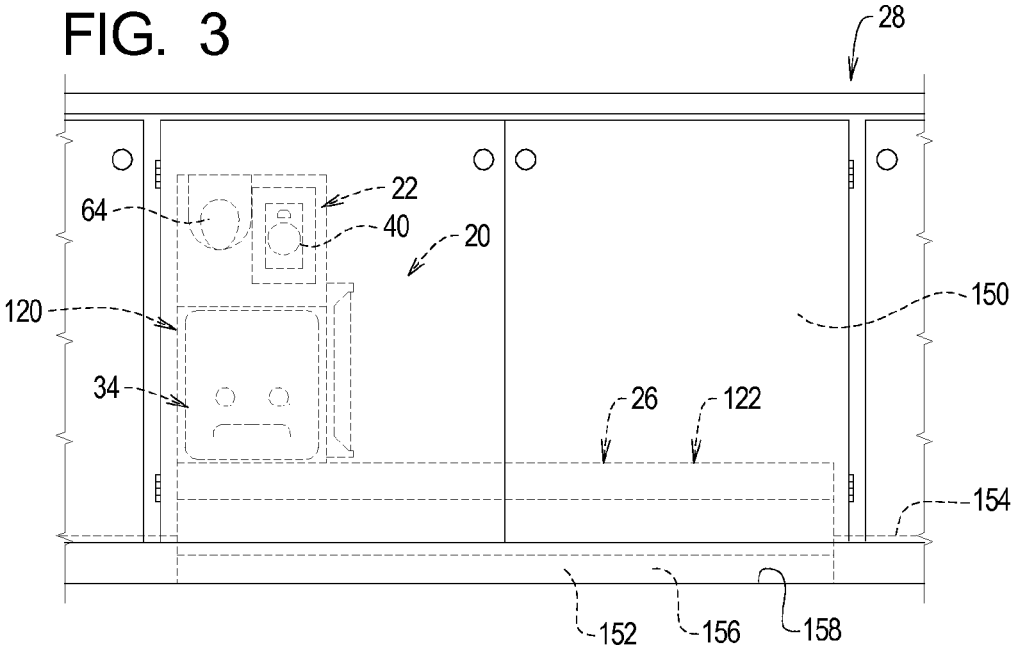
FIG. 3 is front elevation view of the first example vacuum cleaning system of the present invention as stored in a cabinet with doors closed.
Figure 4:
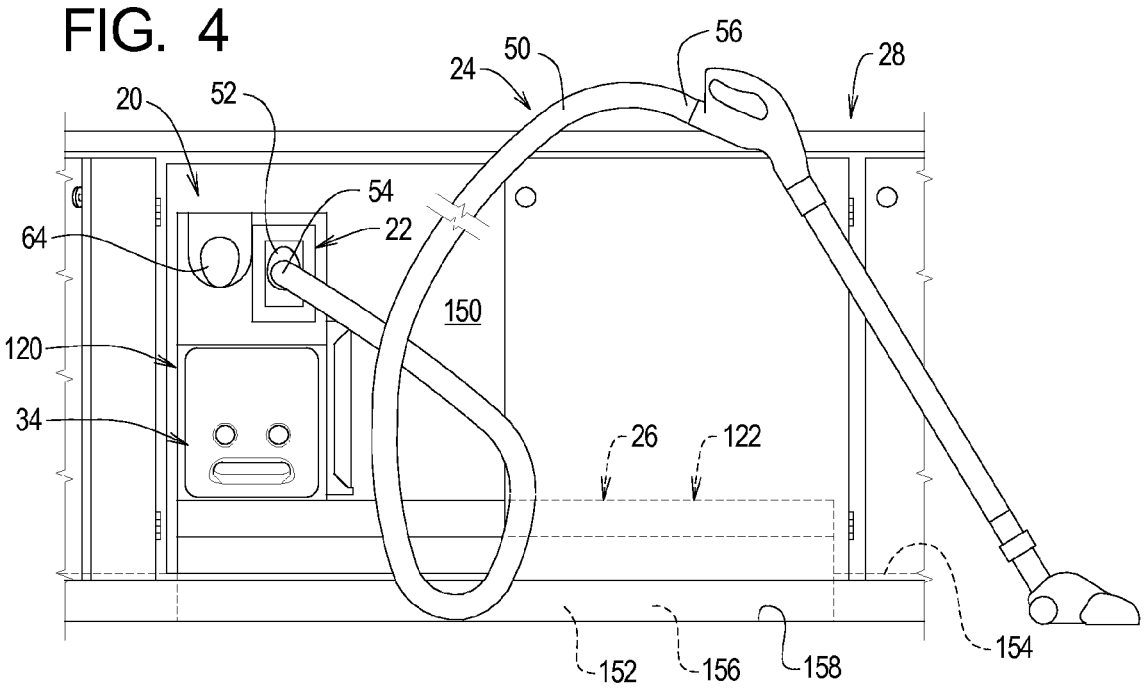
FIG. 4 is front elevation view of the first example vacuum cleaning system of the present invention as stored in a cabinet with doors open.

Referring initially to FIGS. 1, 3, and 4 of the drawing, depicted therein is a first example vacuum cleaning system 20 constructed in accordance with, and embodying, the principles of the present invention. The example vacuum cleaning system 20 comprises a vacuum system 22, a vacuum hose assembly 24, and a hose storage system 26. As will be apparent from the following discussion, the first example vacuum cleaning system 20 is highly schematically depicted in FIG. 1 to provide an overview of the operation thereof. FIGS. 3 and 4 depict one example installation of the example hose cleaning system 20 as installed within a cabinet assembly 28.

The example vacuum system 22 comprises a vacuum assembly 30, an inlet structure 32, a debris chamber structure 34, a chamber filter 36, and an outlet filter 38. The inlet structure 32 defines a vacuum inlet port 40 and a common chamber 42, and the debris chamber structure 34 defines a debris chamber 44. An inlet port door 46 allows the vacuum inlet port 40 to be selectively opened or closed. The vacuum inlet port 40 is in fluid communication with the debris chamber 44 through the common chamber 42.

The example hose assembly 24 comprises a hose member 50 and a hose end carrier 52. The hose member 50 defines a proximal hose end 54 and a distal hose end 56. The hose end carrier 52 is secured to the hose member adjacent to the proximal hose end 54. A hose plug 58 is provided to selectively close the distal hose end 56 as shown in FIG. 2.

The example hose storage system 26 comprises a hose storage structure 60 defining a storage chamber 62 having a storage chamber inlet port 64 and a storage chamber outlet 66. The hose storage system 26 further comprises a door system 68 arranged adjacent to the storage chamber inlet port 64 as will be described in further detail below. The example storage chamber 62 comprises an inlet portion 70, a first serpentine portion 72, an intermediate portion 74, a second serpentine portion 76, and outlet portion 78. The inlet portion 70 defines the storage chamber inlet port 64, and the outlet portion 78 defines the storage chamber outlet 66.

In the example vacuum system 22, a bridge structure 80 defining a bridge chamber 82 extends between the inlet housing 32 and the storage housing 60. The common chamber 42 is in fluid communication with the storage chamber outlet 66 through the bridge chamber 82. First, second, and third access ports 84, 86 and 88 are formed in the bridge structure 80 to allow access to the bridge chamber 82. The access ports allow the vacuum cleaning system 20 to be connected to a separate central vacuum cleaning system and/or to allow the example vacuum cleaning system 20 to be connected to other external ports such as example vacuum inlet port 40 or to a vac pan assembly (not shown) mounted in the kickspace of a cabinet. The access ports 84, 86, and 88 are provided as a convenience, and a vacuum system of the present invention may be made with more or fewer access ports or even without any access ports.

The example vacuum system 20 operates in one of two modes. In a first, operating, mode, the proximal end 54 of the hose assembly 24 is connected to the vacuum system 22 as shown by broken lines in FIG. 1. In this first mode, the door system 68 is configured to prevent fluid flow through the storage chamber inlet port 64. Operating the vacuum system 22 causes air to be drawn along a vacuum path 90 extending through the hose member 50, the vacuum inlet port 40, the common chamber 42, the chamber filter 36, through the vacuum assembly 30, and out through outlet filter 38. Debris is entrained by the air flowing along the vacuum path 90. Much of the debris entrained by the air flowing along the vacuum path 90 is deposited in the debris chamber 44. The remaining debris entrained by air flowing along the vacuum path is removed by the chamber filter 36 or the outlet filter 38.

Figure 2A:
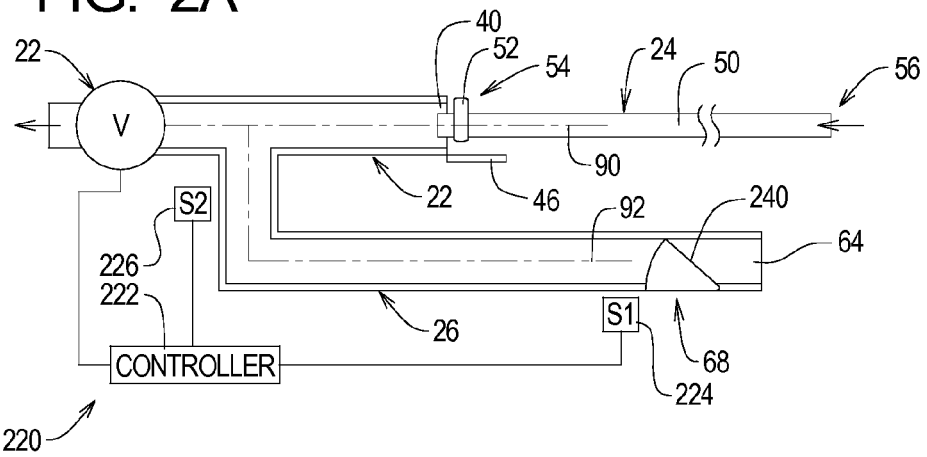
FIGS. 2A-D are highly schematic views of the operation of a vacuum assisted hose storage system of the first example cleaning system.
Figure 2B:
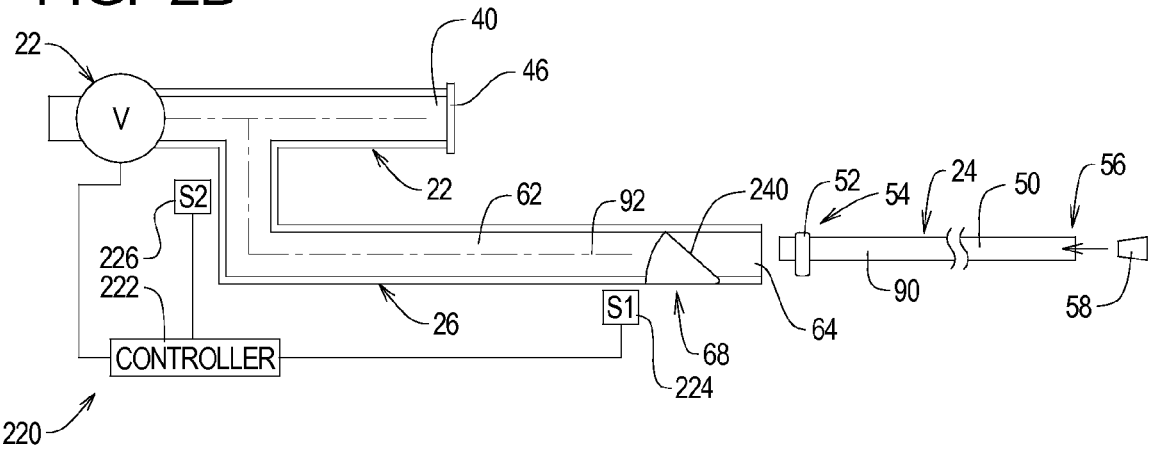

In a second, retraction, mode, hose assembly 24 is retracted into the hose storage chamber 62. The second mode is best understood with reference to both FIG. 1 and FIGS. 2A-2D. Initially, the proximal end 54 of the hose assembly 24 is disconnected from the vacuum system 22, and the inlet port door 46 is configured to close the vacuum inlet port 40. Next, the hose plug 58 is secured to the distal end 56 of the house member 50 to prevent passage of air therethrough as shown in FIG. 2A. The proximal end 54 of the hose member 50 and the hose end carrier 52 attached thereto are then inserted through the storage chamber inlet port 64 such that the end of the hose member 50 and/or the hose end carrier 52 cause the door system 68 to open as shown in FIG. 2B. The opening of the door system 68 causes the vacuum assembly 30 to operate as shown by arrows in FIGS. 2B and 2C.

Figure 2C:
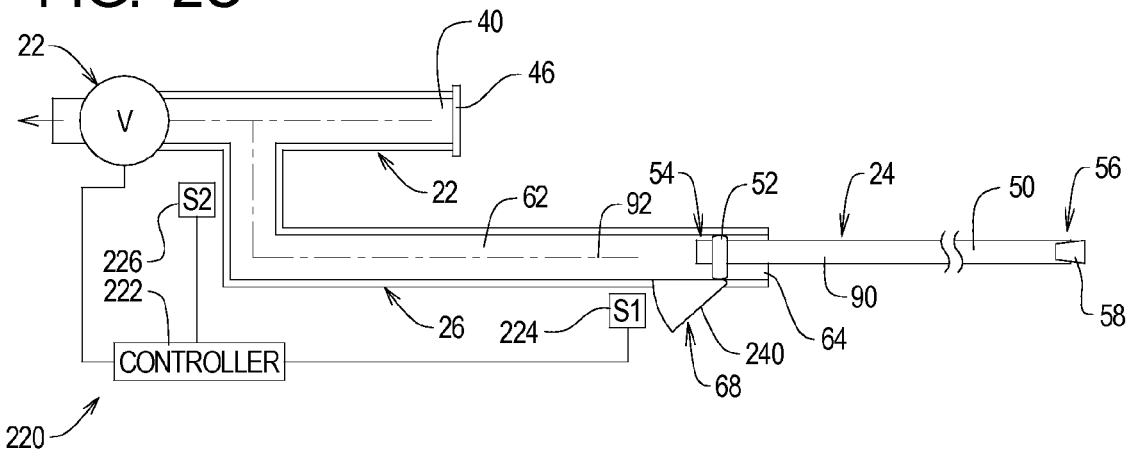
Figure 2D:
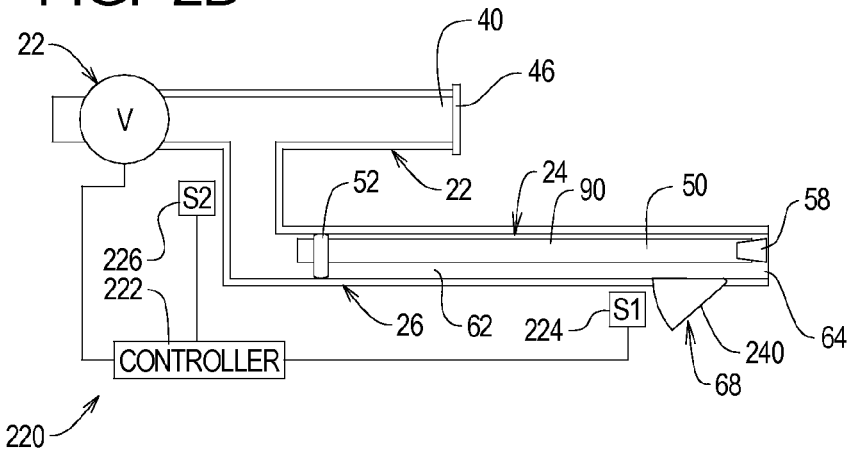

When the vacuum assembly 30 operates, the hose end carrier 52 and the plug 58 prevent flow of air through the storage chamber 62, and a vacuum is established within the storage chamber 62. The vacuum within the storage chamber 62 exerts a retraction force on the vacuum hose assembly 24 such that the vacuum hose assembly 24 is drawn into the storage chamber 62 along a storage path 92 as generally shown in FIG. 2C. More specifically, the storage path 92 extends through the inlet portion 70, first serpentine portion 72, intermediate portion 74, second serpentine portion 76, and outlet portion 78 of the storage chamber 62 as described with reference to FIG. 1. When the vacuum hose assembly 24 is completely withdrawn or retracted into the storage chamber 62 as shown in FIG. 2D, the vacuum assembly 30 is turned off.

To remove the vacuum hose assembly 24 from the storage chamber 62, the distal end 56 of the vacuum hose assembly 24 is pulled to extract the vacuum hose assembly 24 from the storage chamber 62.

Figure 5:
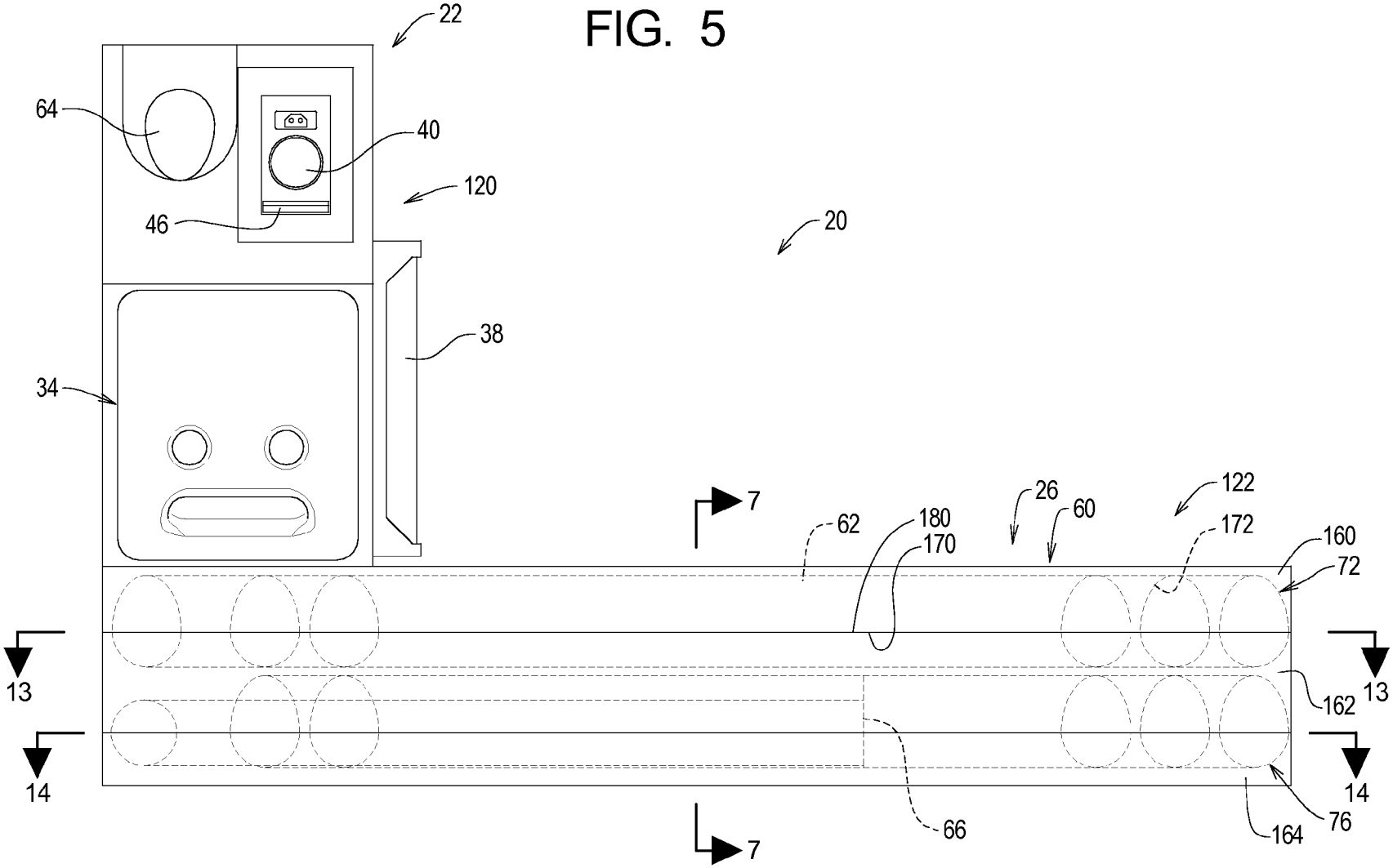
FIG. 5 is a front elevation view of the first example vacuum cleaning system of the present invention.
Figure 6:
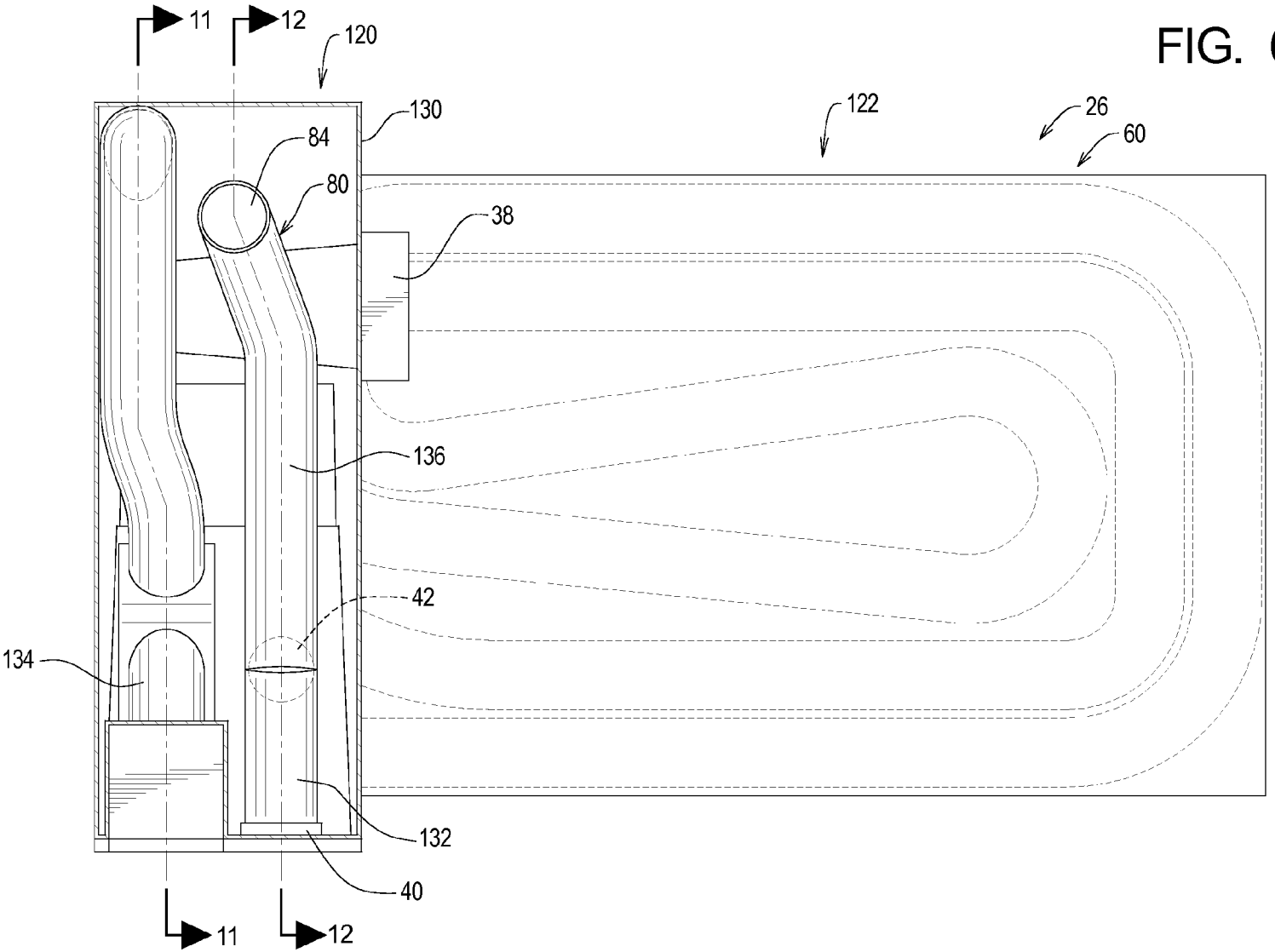
FIG. 6 is a top plan view of the first example vacuum cleaning system of the present invention with a top cover removed.

Referring now to FIGS. 3-7 of the drawing, an example installation of the first example cleaning system 20 will now be described in further detail. FIG. 5 illustrates that the first example cleaning system 20 comprises a main housing assembly 120 and a tray assembly 122. The main housing assembly 120 comprises a main housing 130 including a vacuum inlet conduit 132 that defines the inlet structure 32 and the debris chamber structure 34. The main housing 130 contains or otherwise supports the vacuum system assembly 30, the chamber filter 36, and the outlet filter 38.

With reference to FIGS. 3-7, and also to FIG. 1, it can be seen that the main housing assembly 120 further defines a storage inlet conduit 134 and a bridge conduit 136. The example main housing assembly 120 further comprises first, second, and third access plates 140, 142, and 144 for selectively covering the first, second, and third access ports 84, 86, and 88, respectively (see, e.g., FIG. 1). The storage inlet conduit 134 defines the inlet portion 70 of the storage chamber 62. The bridge conduit 136 forms the bridge structure 80 defining the bridge chamber 82. The access plates 140, 142, and 144 are detachably attached to the main housing assembly 120 to allow selective access to the access ports 84, 86, and 88, respectively.

The tray assembly 122 defines the first serpentine portion 72, intermediate portion 74, the second serpentine portion 76, and the outlet portion 78 of the storage chamber 62. The storage inlet conduit 134 is operatively connected to the tray assembly 122 such the inlet portion 70 and first serpentine portion 72 of the storage chamber 62 are fluid communication with each other. The bridge housing 136 is connected to inlet structure 32 defined by the main housing assembly 120 such that the bridge chamber 82 is in fluid communication with the common chamber 42. The bridge housing 136 is also connected to the tray assembly 122 such that the bridge chamber 82 is in fluid communication with the outlet portion 78 of the storage chamber 62.

FIGS. 3 and 4 further show that the example cabinet assembly 28 defines a cabinet chamber 150 and a kickspace chamber 152. In the example installation depicted in FIGS. 3 and 4, a bottom wall 154 of the cabinet assembly 28 is at least partly removed to define a tray opening 156. The cabinet assembly 28 is sitting on a floor 158. The tray assembly 122 sits on the floor 158 and occupies much of the kickspace chamber 152 and extends through the tray opening 156 to occupy at least a portion of the cabinet chamber 150. As will described in further detail below, the tray assembly 122 is designed such that the dimensions thereof are as compact as possible such that the tray assembly 122 occupies as little of the cabinet chamber 150 as possible.

FIGS. 5-7, 9-12, and 15 perhaps best show that the example tray assembly 122 comprises a top tray member 160, a middle tray member 162, and a bottom tray member 164 joined together to define the first serpentine portion 72, intermediate portion 74, the second serpentine portion 76, and the outlet portion 78 of the storage chamber 62 as generally described above. It should be noted that, in at least some of the drawing figures (e.g., FIG. 7), the tray members 160, 162, and 164 are depicted with shading suggesting that these tray members 160, 162, 164 are solid, generally rectangular parts. In fact, the tray members 160, 162, and 164 need not be made of rectangular and/or solid parts. To the contrary, these tray members 160, 162, and 164 can, in fact, be made of any combination of shapes, materials, and/or construction techniques that allow the portions 72, 74, 76, and 78 of the storage chamber 62 to be defined as described in further detail below.

Figure 7:
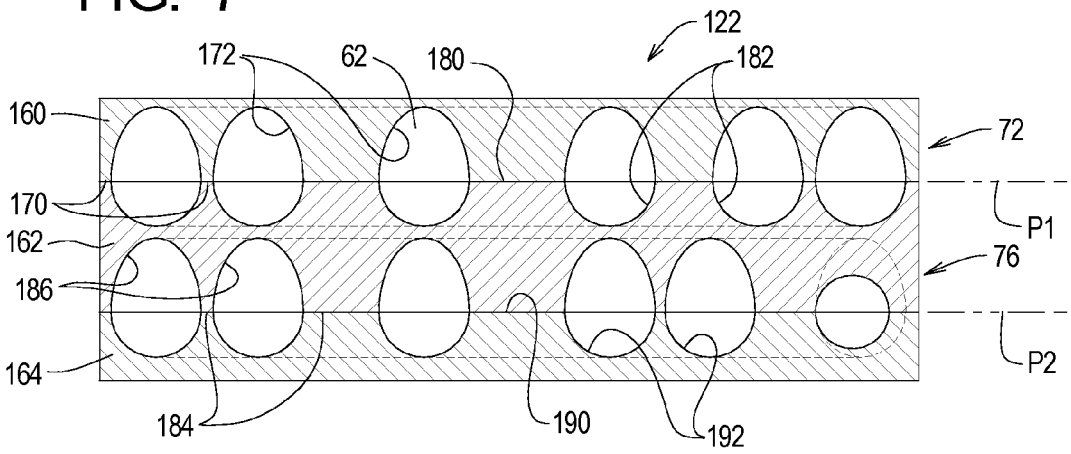
FIG. 7 is a section view taken along lines 7-7 in FIG. 5.

FIGS. 5 and 7 show that the top tray member 160 defines a plurality of top mating surface portions 170 and a plurality of top cavity surface portions 172. These figures further show that the middle tray member 162 defines a plurality of first middle mating surface portions 180, a plurality of first middle cavity surface portions 182, a plurality of second middle mating surface portions 184, and a plurality of second middle cavity surface portions 186. In addition, the bottom tray member 164 defines a plurality of bottom mating surface portions 190 and a plurality of bottom cavity surface portions 192.

When the top tray member 160 is connected to the middle tray member 162, the plurality of top mating surface portions 170 engage the plurality of first middle mating surface portions 180 to form a fluid tight seal where these surfaces 170 and 180 interface. So connected together, the plurality of top cavity surface portions 172 and the plurality of first middle cavity surface portions 182 define at least the first serpentine portion 72 of the storage chamber 62.

With the top tray member 160 connected to the middle tray member 162, the bottom tray member 164 is also connected to the middle tray member 162 such that the plurality of bottom mating surface portions 190 engage the plurality of second middle mating surface portions 184 to form a fluid tight seal where these surfaces 190 and 184 interface. So connected together, the plurality of bottom cavity surface portions 192 and the plurality of second middle cavity surface portions 186 define at least the second serpentine portion 76 of the storage chamber 62.

When combined as described above, FIGS. 5 and 7 show that the example tray members 160, 162, and 164 form the first and second serpentine portions 72 and 76 such that these portions 72 and 76 define first and second reference planes P1 and P2 and such that these reference planes P1 and P2 are substantially parallel. Although the reference planes defined by the serpentine portions 72 and 76 need not be parallel, a tray assembly 122 defining parallel reference planes can be made more compact.

Further, FIGS. 5 and 7 indicate that at least some of the plurality of first middle cavity surface portions 182 are arranged directly above at least some of the plurality of second middle cavity surface portions 186. Alternatively, the first and second middle cavity surface portions 182 and 186 may be offset from each other to allow the distance between the reference planes P1 and P2 to be reduced, again to minimize a volume occupied by the example tray assembly 122.

Figure 10:
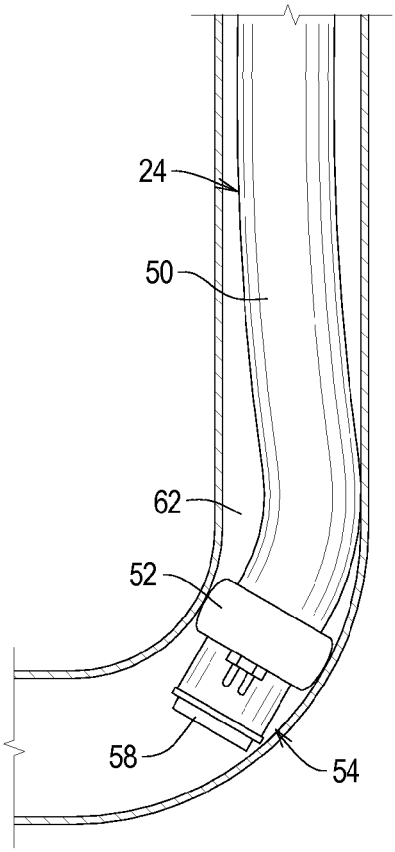
FIG. 10 is a partial section view illustrating navigation of a proximal hose end supported by the first example hose end carrier through a first example storage chamber.
Figure 11:
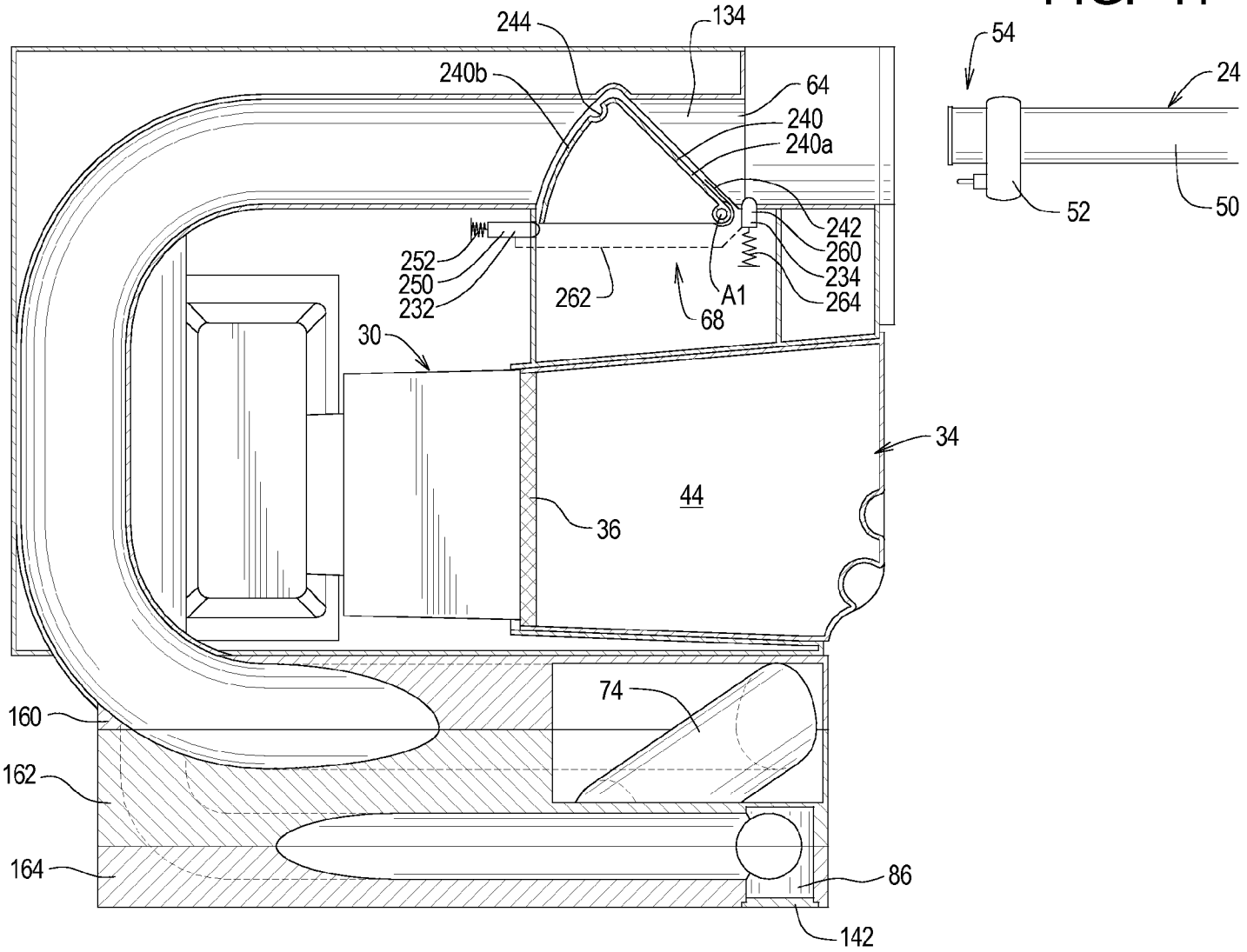
FIG. 11 is a section view taken along lines 11-11 in FIG. 6.
Figure 12:
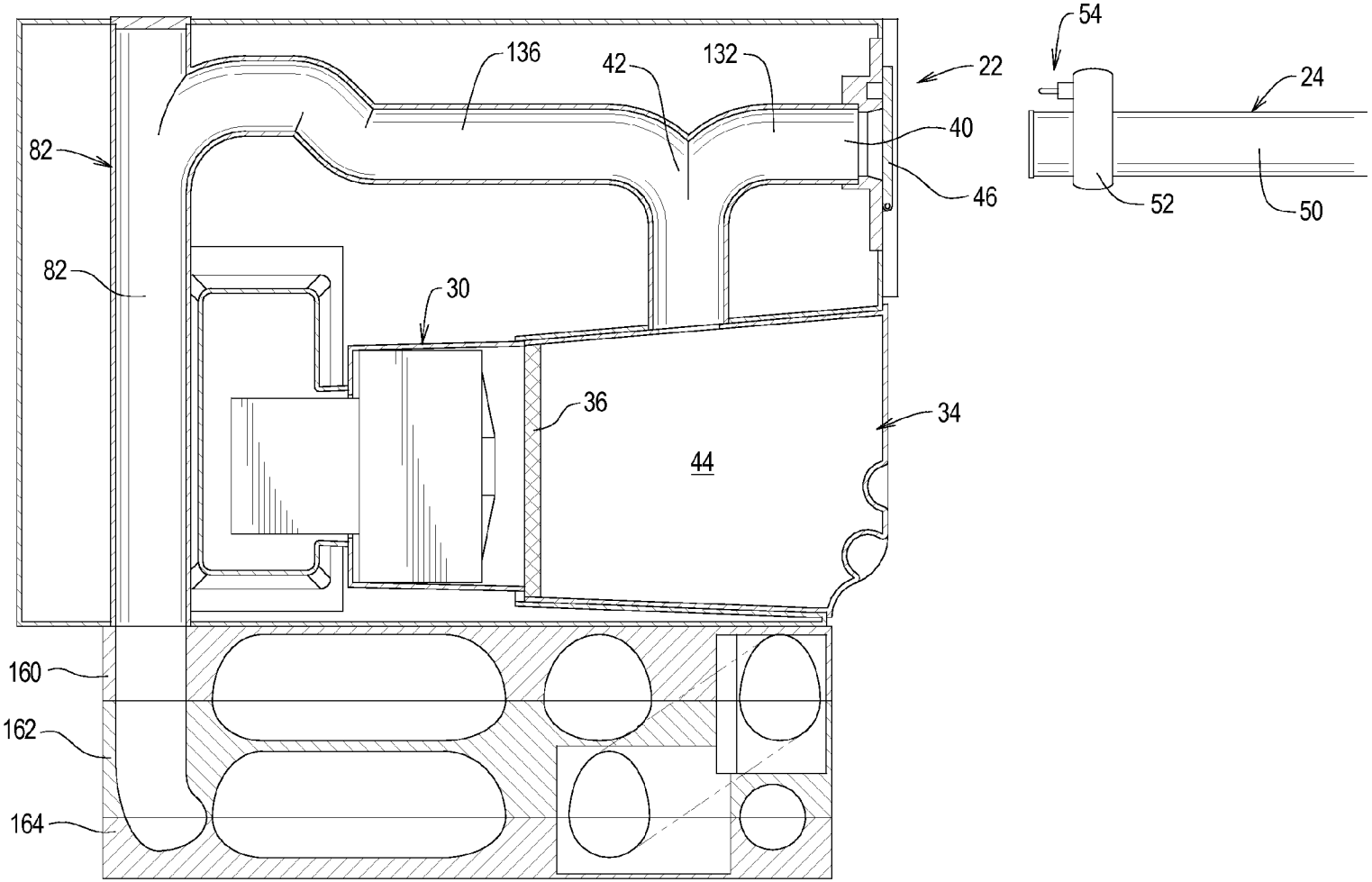
FIG. 12 is a section view taken along lines 12-12 in FIG. 6.

Further, as shown for example in FIGS. 11 and 12, at least portions of some of the cavity surface portions 172, 182, 186, and 192 may be formed such that they extend at angles with respect to the reference planes P1 and P2. As an example, the intermediate portion 74 of the storage chamber 62 is formed by angled portions of the cavity surface portions 172, 182, 186, and 192 to allow the first serpentine portion 72 to be connected to the second serpentine portion 76. FIG. 10 further shows that the cavity surface portions 172, 182, 186, and 192 are formed to define a portion of the bridge chamber 82 and that the cavity surface portions 172, 182, 186, and 192 forming this portion of the bridge chamber 82 extend at substantially right angles to the reference planes P1 and P2.

In the following discussion, the term "reference dimension" as used herein with respect to the hose member 50 and the hose end carrier 52 refers to a largest lateral dimension of these members 50 and 52 from a vertical reference plane extending through a center point of the volume defined by the members 50 and 52. The term "reference dimension" as used herein with respect to the storage chamber 62 refers to a largest lateral dimension of the storage chamber 50 from a vertical reference plane extending through a center point of the volume defined by the storage chamber 50. The terms "lateral" and "vertical" are used to refer to those dimensions of various components of the vacuum cleaning system 20 when the vacuum cleaning system 20 in a normal, upright configuration.

FIGS. 5 and 7 perhaps best illustrate that a cross-sectional area of the storage chamber 62 may be described as egg-shaped. Similarly, FIG. 9A illustrates that a cross-sectional area of the hose end carrier 52 is similarly egg-shaped, but is slightly smaller than, the cross-sectional area of the storage chamber 62 such that hose end carrier 52 fits snugly within the storage chamber 62.

Figure 9A:
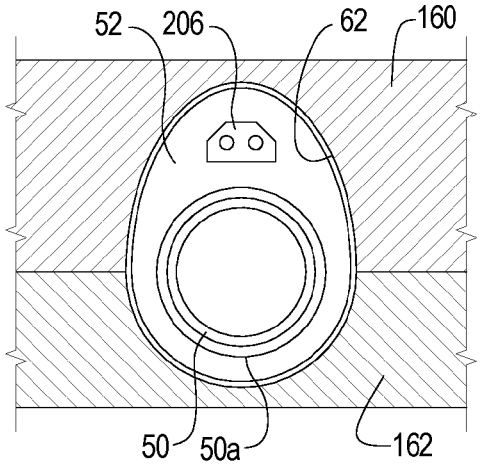
FIG. 9A is a section view illustrating a first example hose end carrier of the present invention.

FIG. 9A further illustrates that of the reference dimension associated with an outer surface 50*a* of the hose member 50 is substantially smaller than the reference dimension associated with the hose end carrier 52. In the example hose storage system 26, the reference dimension associated with the hose end carrier 52 is approximately 25% larger than that defined by the outer surface 50*a* of the hose member 50. The reference dimension associated with the hose end carrier 52 should be within a first range of between 15% and 40% larger than the reference dimension associated with the outer surface 50*a* of the hose member 50 or within a second range of between 15% and 150% larger than reference dimension associated with the outer surface 50*a* of the hose member 50.

The exact determination of the relative reference dimensions of the hose member 50 and hose end carrier 52 will also be determined at least in part based on a length of the hose member 50 that extends beyond the hose end carrier 52 as perhaps best shown in FIG. 10. Keeping the length of the hose member 50 that extends beyond the hose end carrier 52 to a minimum allows the reference dimension of the hose carrier 52 to be minimized.

Further, the length of the reference dimension of the base carrier 52 to should, in general, be kept to a minimum to reduce the cross-sectional area of the hose chamber 62 and thus the size of the tray assembly 122.

As shown in FIG. 10, the oversizing of the cross-sectional area of the hose end carrier 52 with respect to the cross-sectional area of the outer surface 50*a* of the hose member 50 allows the proximal hose end 54 to pivot when rounding corners. This pivoting action caused by the hose end carrier 52 allows the proximal hose end 54 to navigate relatively tighter corners than could be navigated by the proximal hose end 54 without the hose end carrier 52. The ability of the proximal hose end 54 to navigate tighter corners allow more linear feet of storage chamber 62 to be formed by the cavity surface portions 172, 182, 186, and 192 defined by the tray members 160, 162, and 164.

Figure 8:
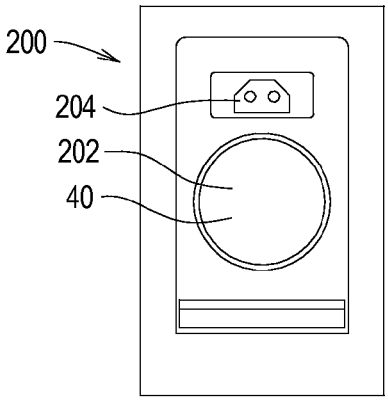
FIG. 8 is a front elevation view of an example hose end receptacle.
Figure 15:
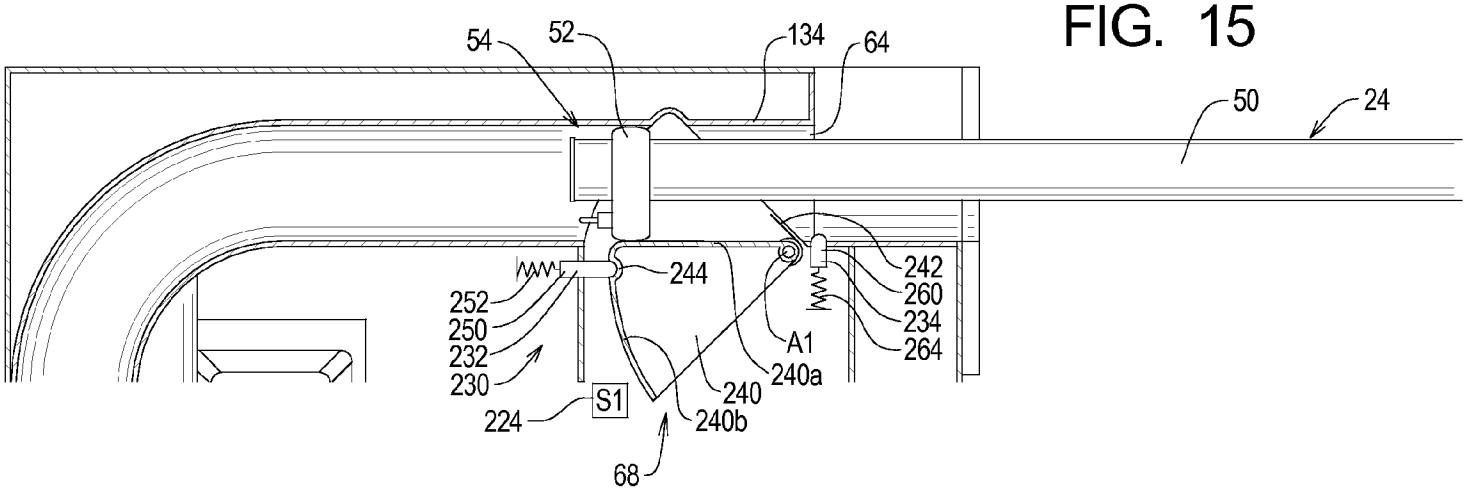
FIGS. 15, 16, and 17 are partial section views similar to FIG. 11 depicting the operation of a door latch assembly of the present invention.

Referring for a moment to FIG. 8 of the drawing, depicted therein is an industry standard receptacle assembly 200 that may form the vacuum inlet port 40. FIG. 8 shows that the receptacle assembly 200 comprises a vacuum opening 202 and a socket assembly 204. Referring back to FIG. 9A of the drawing, it can be seen that a plug assembly 206 is formed on the example hose end carrier 52. The hose end carrier 52 is sized and dimensioned such that the socket assembly 204 receives the plug assembly 206 when the vacuum opening 202 receives the proximal hose end 54 as shown in FIG. 15.

The socket assembly 204 is adapted to receive the plug assembly 206 such that electric power available at the socket assembly 204 may be transmitted to the plug assembly 206. The plug assembly 206 may in turn be electrically connected by wires (not shown) extending along the hose member 50 to an electrical device (e.g., power head, light, not shown) located at, for example, the distal end 56 of the hose assembly 24.

Figure 9B:
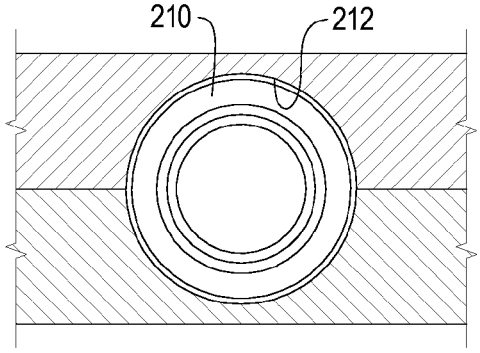
FIG. 9B is a section view illustrating a second example hose end carrier of the present invention.

FIG. 9B of the drawing depicts a second example hose end carrier 210 that may be used in place of the example hose end carrier 52. The second example hose end carrier 210 is circular in cross-section and does not have a plug assembly such as the plug assembly 206. FIG. 9B illustrates that the second example hose end carrier 210 is adapted to work with a second example storage cavity 212 having a similar circular cross-sectional area and sized and dimensioned to snugly receive the second example hose end carrier 210. The cross-sectional area of the second example hose end carrier 210 is larger than a cross-sectional area of an outer surface 50*a* of the hose member 50 to allow pivoting of the proximal hose end 54 as described above with reference to the first hose end carrier 52.

Figure 9C:
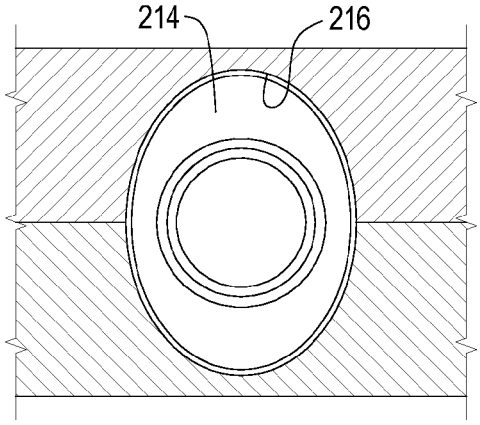
FIG. 9C is a section view illustrating a third example hose end carrier of the present invention.

FIG. 9C of the drawing depicts a third example hose end carrier 214 that may be used in place of the example hose end carrier 52. The second example hose end carrier 214 is oval in cross-section and also does not have a plug assembly such as the plug assembly 206. FIG. 9C illustrates that the third example hose end carrier 214 is adapted to work with a third example storage cavity 216 having a similar circular cross-sectional area and sized and dimensioned to snugly receive the second example hose end carrier 214. Again, the cross-sectional area of the second example hose end carrier 214 is larger than a cross-sectional area of an outer surface 50*a* of the hose member 50 to allow pivoting of the proximal hose end 54 as described above with reference to the first hose end carrier 52.

Although neither the second nor the third example hose end carriers 210 and 214 employ a plug assembly, appropriate sizing of the hose end carriers 210 and 214 may allow a plug assembly to be formed thereon.

A major consideration of a vacuum cleaning system 20 as described herein is that the vacuum cleaning system 20 be as compact as possible. The use of the hose end carriers 52, 210, and 214 described herein allows the turn radii formed by at least the serpentine portions 72 and 76 of the storage chamber 62 to be kept very small. In addition, the formation of the storage chamber with a tray assembly 122 comprising the three tray members 160, 162, and 164 allows very tight vertical stacking of the serpentine portions 72 and 76.

The tight turn radii allowed by the cross-sectional areas of the hose end carriers 52, 210, and 214 and the storage chamber 62 and the tight vertical stacking of the serpentine portions 72 and 76 significantly increase a density of the linear length of the storage chamber 62 per volume of the hose storage structure 60.

Referring now to FIGS. 2A-D, 11, and 15-17 of the drawing, the operation of the hose storage system 26 will now be described in further detail. As perhaps best shown in FIGS. 2A, 2B, 2C, and 2D, the example hose storage system 26 comprises a control system 220. The example control system 220 comprises a controller 222 and first and second sensors 224 and 226. The first sensor 224 is arranged to detect a status of the door latch assembly 68. The second sensor 226 is arranged to detect when the proximal hose end 54 is near the outlet portion 78 of the storage chamber 62.

Referring now to FIGS. 11 and 15-17, the example door system 68 will now be described in further detail. The example door system 68 comprises a latch door assembly 230, a latch assembly 232, and a release assembly 234.

The latch door assembly 230 comprises a latch door 240 and a door biasing member 242 such as a torsion spring. The latch door 240 pivots between closed (FIGS. 11 and 17) and open (FIGS. 15 and 16) positions about a pivot axis A1. The latch door 240 defines first and second latch surfaces 240*a* and 240*b*, and a latch cavity 244 is formed in the second latch surface 240*b*. When in the closed position, the latch door 240 substantially prevents air from flowing into the storage chamber 62 through the storage chamber inlet port 64. When in the open position, the latch door 240 is displaced to allow access to the storage chamber 62 through the storage chamber inlet port 64. The latch door 240 is biased into the closed position by the door biasing member 242.

Figure 16:
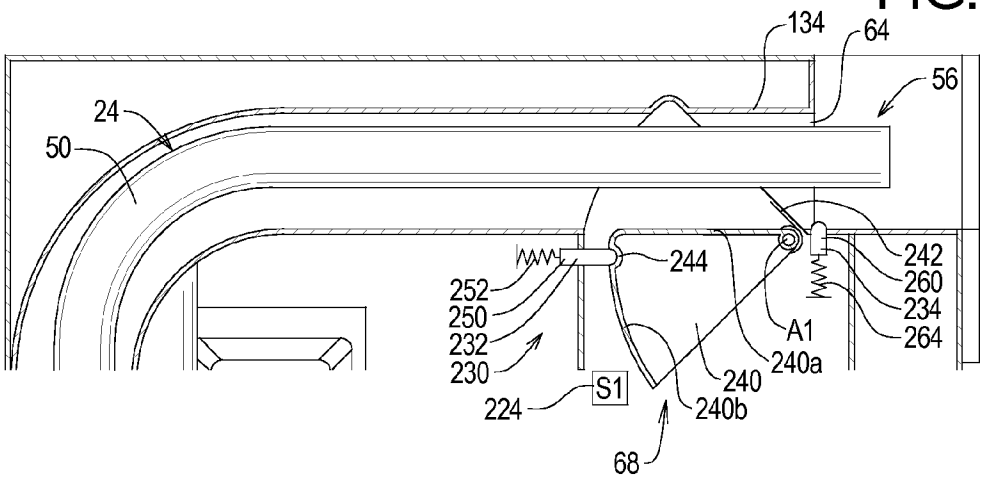

The example latch assembly 232 comprises a latch member 250 and a latch biasing member 252 such as a compression spring. The latch member 250 is supported for movement between an unlatched position (FIGS. 11 and 17) and a latched position (FIGS. 15 and 16). The latch biasing member 252 biases the latch member 250 towards the unlatched position.

Figure 17:
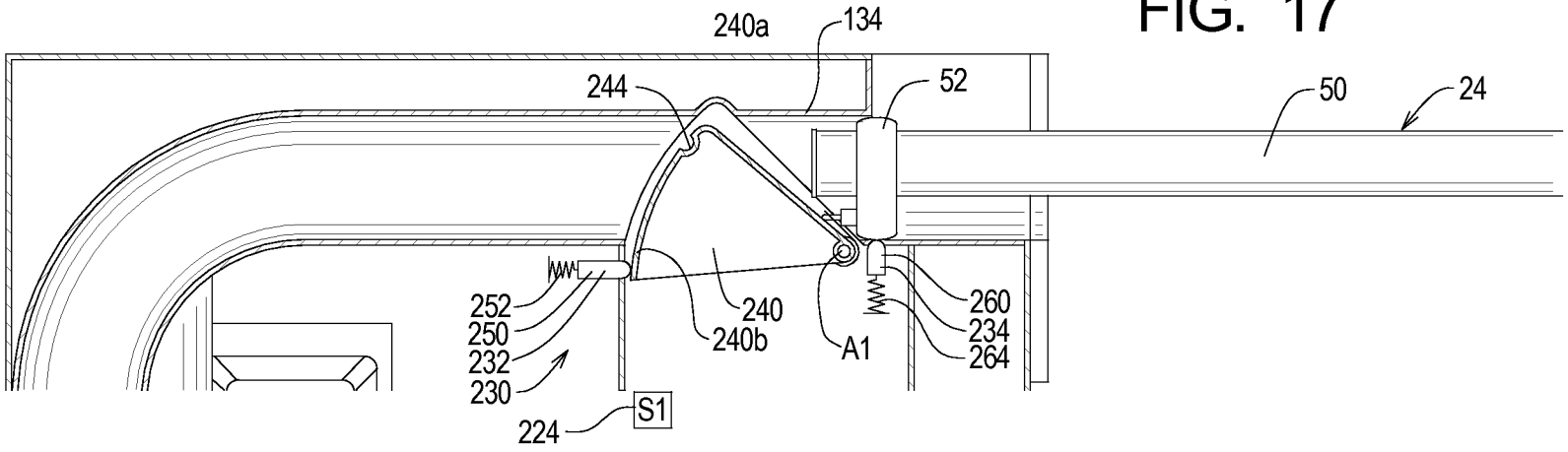
Figure 18:
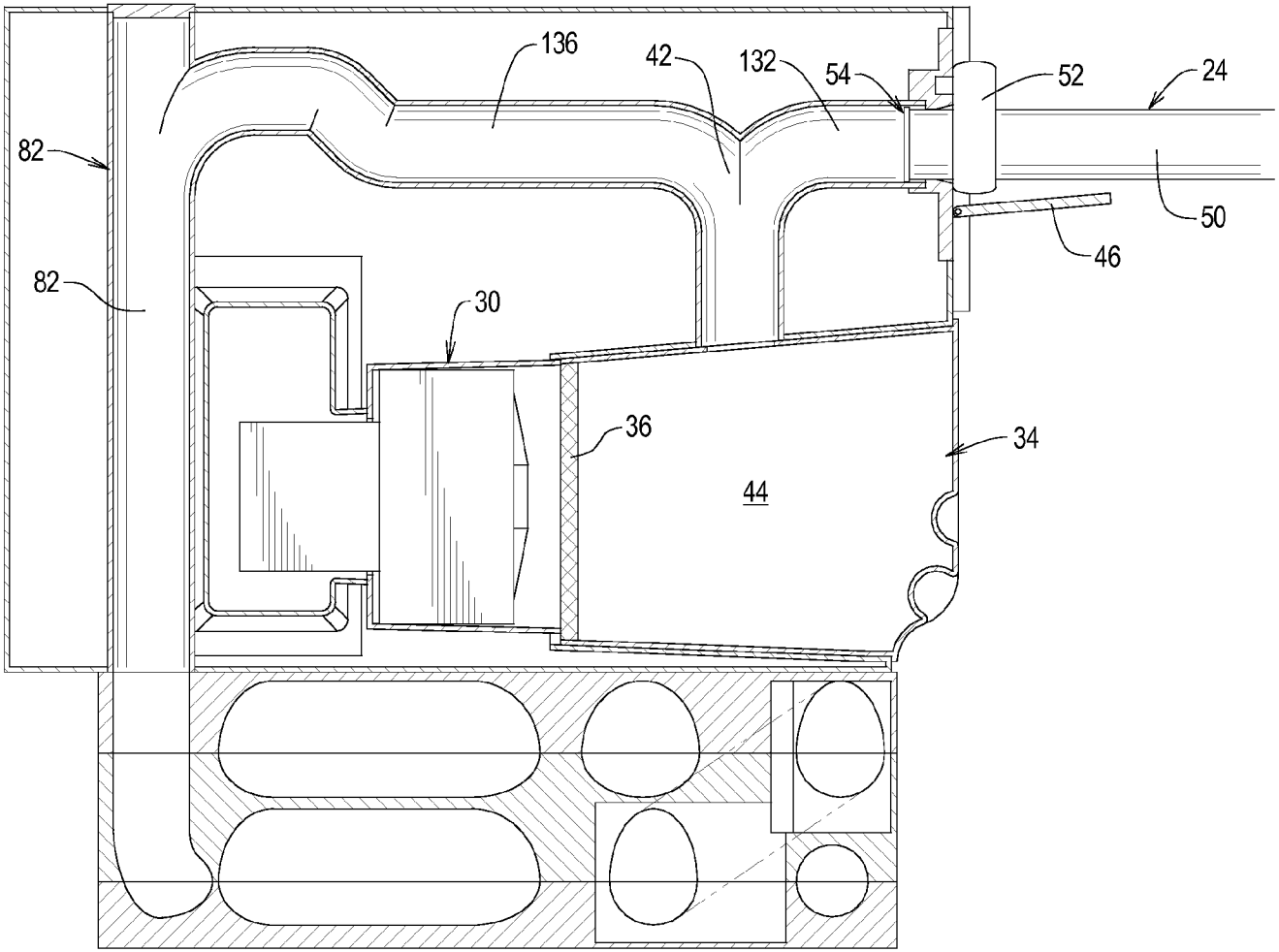
FIG. 18 is a side elevation section view illustrating the operation of the first example vacuum cleaning system in a cleaning mode.

The example release assembly 234 comprises a release member 260, a link member 262, and a release biasing member 264 such as a compression spring. The release member 260 is supported for movement between a protruding position (FIGS. 11, 15, and 16) and a depressed position (FIG. 17). The release biasing member 264 biases the release member towards the protruding position. Further, the link member 262 connects the release member 260 to the latch member 250 such that movement of the release member 260 from the protruding position to the depressed position displaces the latch member 250 from the latched position to the unlatched position.

When the vacuum cleaning system 20 is in the operating or vacuum mode, the door biasing member 242 biases the latch door 240 into its closed position to prevent vacuum from being lost through the storage chamber inlet port 64.

When the vacuum cleaner system 20 is to be operated in its hose retraction mode, the proximal hose end 54 is inserted through the door chamber inlet port 64 as shown in FIG. 15. The proximal hose end 54 and/or the hose end carrier 52 engage the first door surface 240*a* to move the latch door 240 from its closed position to its open position. As the latch door 240 moves from the closed position to the open position, the latch member 250 rides along the second latch surface 240*b*, and the latch member 250 is held in the unlatched configuration. After the latch door 240 reaches the open position, the latch biasing member 252 forces latch member 250 into the latched position, at which point the latch member 250 enters the latch cavity 244. With the latch member 250 in the latch cavity 244, the latch door 240 is prevented from being moved out of its open configuration.

Additionally, the first sensor 224 is configured to detect when the latch member 250 latches the latch door 240 in the open configuration. When this condition is detected, the controller 222 turns on the vacuum assembly 30 such that a suction is applied to the vacuum hose assembly 24 to retract the vacuum hose assembly 24 into the storage chamber 62 of the hose storage system 26. The principles of the present invention also apply to a mechanical drive system that employs a motor configured to displace the vacuum hose assembly 24 relative to the storage chamber 62. The controller 222 keeps the vacuum assembly 30 or mechanical drive system on until the second sensor 226 detects the presence of the proximal hose end 54 (see, e.g., FIG. 16).

When use of the hose assembly 24 is required, the distal hose end 56 is pulled to extract the hose assembly 24 from the storage chamber 62. As the hose end carrier 52 exits the storage container inlet port 64, the hose end carrier 52 acts on the release member 260, displacing the release member 260 from its protruding position to its depressed position. Through the link member 262, the release member 260 moves the latch member 250 from its latched position to its unlatched position. With the latch member 250 in its unlatched position, the door biasing member 246 returns the door member 240 to its closed configuration. The example vacuum cleaning system 20 may then be used in its cleaning or operating mode.

Figure 13:
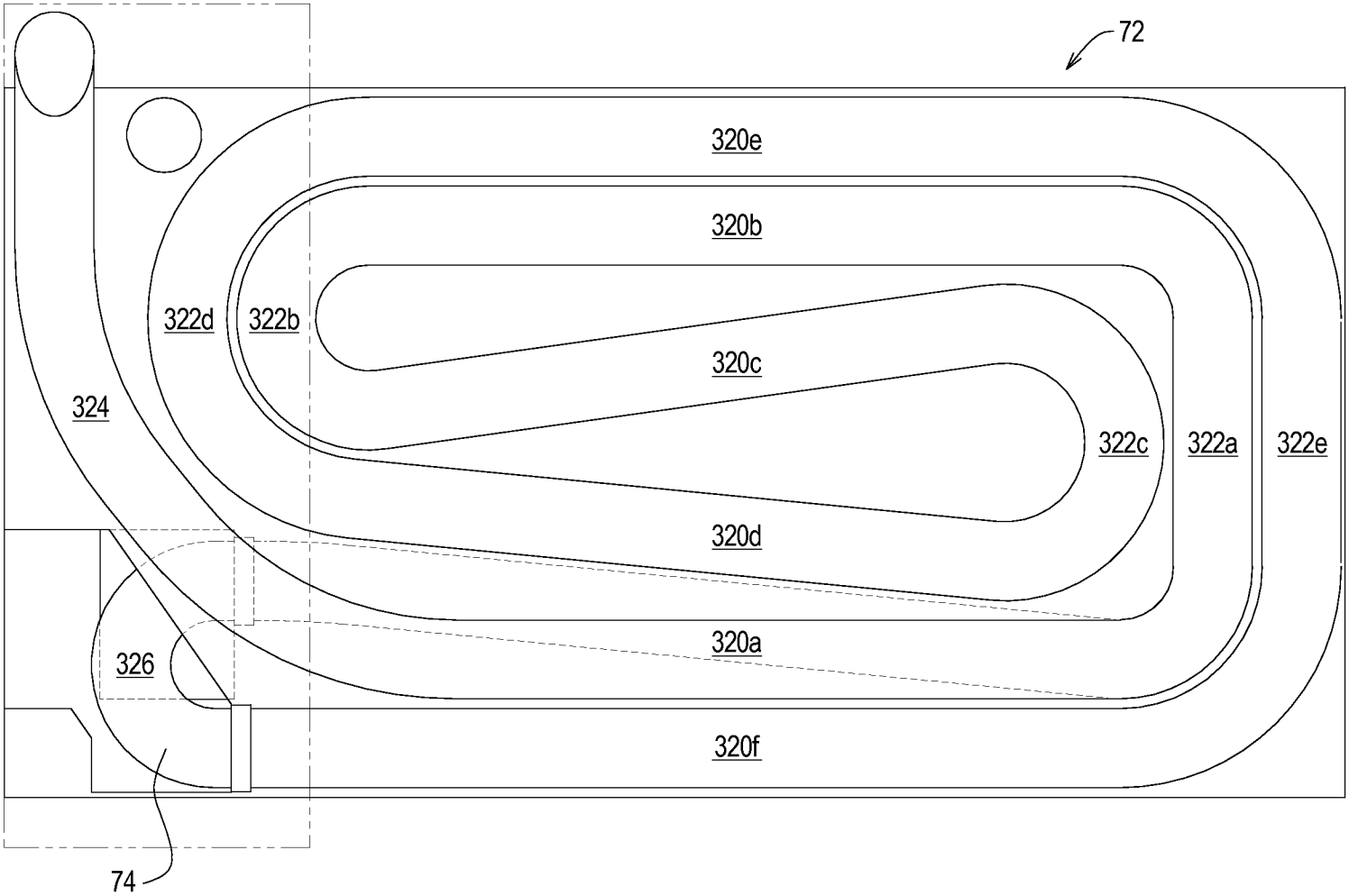
FIG. 13 is a section view taken along lines 13-13 in FIG. 5.

Referring again to FIGS. 5, 12, 13, and 14, the example storage chamber 62 will now be described in further detail. FIGS. 5 and 12 illustrate that the first serpentine portion 72 is arranged above the second serpentine portion 76. FIG. 13 illustrates that the first serpentine portion 72 comprises six straight segments 320*a*, 320*b*, 320*c*, 320*d*, 320*e*, and 320*f* connected by turn return segments 322*a*, 322*b*, 322*c*, 322*e*, and 322*e*. An end segment 324 connects the first serpentine portion 72 to the storage chamber inlet portion 70. A transition segment 326 connects the first serpentine portion 72 to the second serpentine portion 74.

Figure 14:
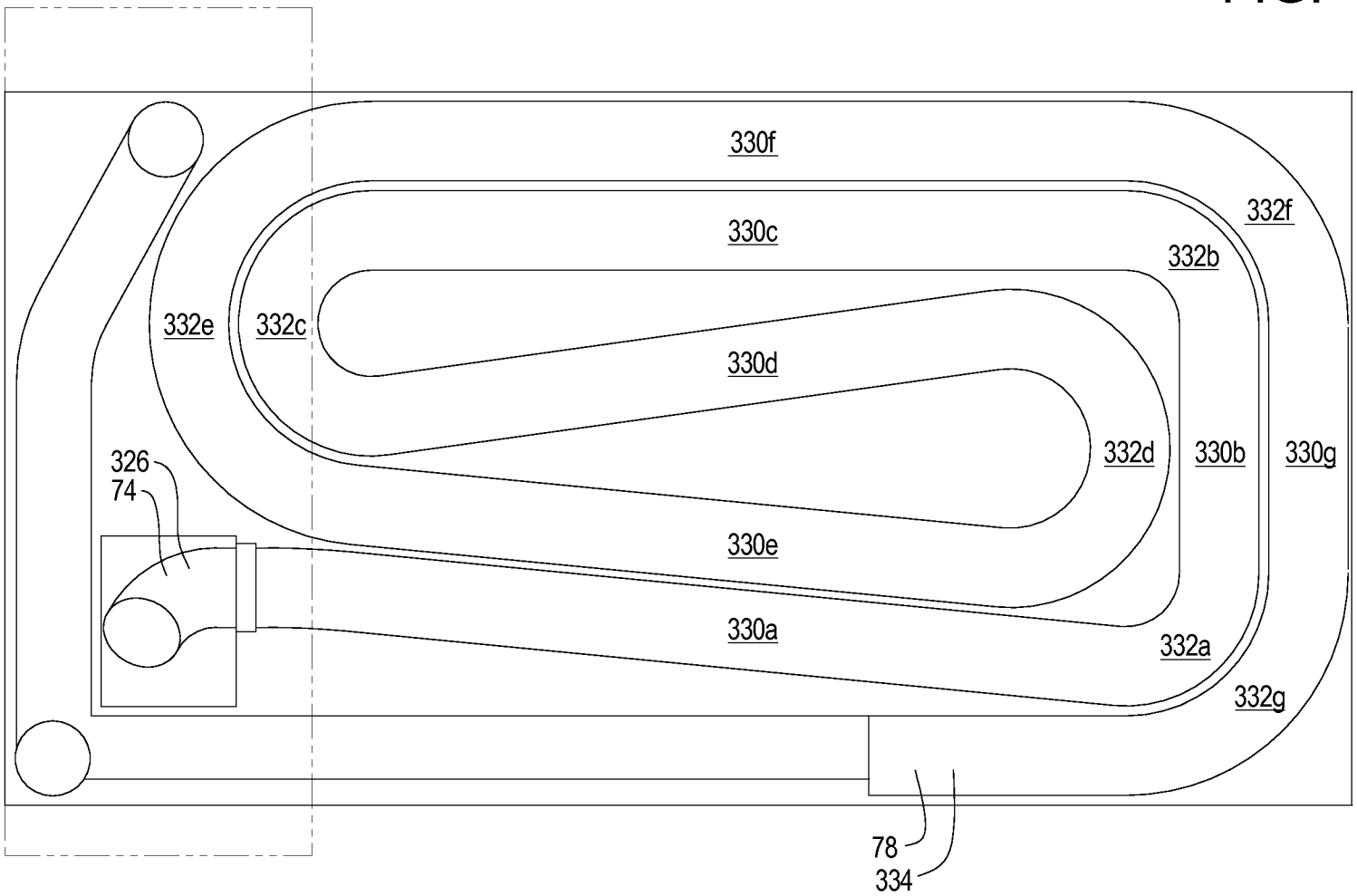
FIG. 14 is a section view taken along lines 14-14 in FIG. 5.

FIG. 14 illustrates that the second serpentine portion 76 comprises seven straight segments 330*a*, 330*b*, 330*c*, 330*d*, 330*e*, 330*f*, 330*g* connected by seven turn segments 332*a*, 332*b*, 332*c*, 332*e*, 332*e*, 330*f*, and 330*g*. An end segment 334 connects the second serpentine portion 76 to the bridge chamber 82.

Referring now more specifically to the debris chamber structure 32, that structure 32 may take the form of a tray 340 that is inserted into and removed from the main housing assembly 120 to facilitate removal of debris that collects in the debris chamber 44.

What is claimed is:

1. A vacuum cleaning system comprising:

a vacuum system comprising a vacuum assembly, an inlet structure defining a vacuum inlet port and a common chamber, and a debris chamber structure defining a debris chamber, where operation of the vacuum assembly draws air through the vacuum inlet port, the common chamber, and the debris chamber;

a hose assembly comprising a hose member and a hose end carrier, where the hose assembly is adapted to be detachably attached to the vacuum inlet port; and a hose storage system comprising a hose storage structure defining a storage chamber having a storage chamber inlet port and a storage chamber outlet operatively connected to the common chamber, where at least one turn portion of the storage chamber is located between the storage chamber inlet port and the storage chamber outlet port; wherein the storage chamber defines a chamber reference distance;

the hose end carrier defines a carrier reference distance, where the carrier cross-sectional area is slightly less than the chamber reference distance;

the hose member defines a hose proximal end;

the hose carrier is spaced from the hose proximal end; and the hose member defines a hose reference distance, where the carrier reference distance is sized and dimensioned relative to the hose member reference distance to facilitate movement of the hose proximal end through the at least one turn portion.

2. A vacuum cleaning system as recited in claim 1, in which the hose storage structure comprises at least first, second, and third parts assembled to define first and second portions of the storage chamber, where the first and second portions vertically spaced from each other.

3. A vacuum cleaning system as recited in claim 1, in which at least one of the first and second portions is serpentine.

4. A vacuum cleaning system as recited in claim 1, in which the carrier reference distance is within a range of between 15% and 40% larger than the hose reference distance.

5. A vacuum cleaning system as recited in claim 1, in which the carrier reference distance is within a range of between 15% and 150% larger than the hose reference distance.

6. A vacuum cleaning system as recited in claim 1, in which a control system is configured to turn the vacuum assembly on when the hose end carrier enters the storage chamber inlet port and turn the vacuum assembly off when the hose end carrier reaches the storage chamber outlet.

7. A vacuum cleaning system as recited in claim 6, further comprising a door configured to open when the hose end carrier enters the storage chamber, where the control system turns the vacuum assembly on when the door opens.

8. A vacuum cleaning system comprising:
a vacuum system comprising
a vacuum assembly,
an inlet structure defining a vacuum inlet port and a common chamber, and
a debris chamber structure defining a debris chamber, where
operation of the vacuum assembly draws air through the vacuum inlet port, the common chamber, and the debris chamber;
a hose assembly adapted to be detachably attached to the vacuum inlet port; and
a hose storage system comprising a hose storage structure defining a storage chamber having a storage chamber inlet port and a storage chamber outlet operatively connected to the common chamber; wherein
the hose storage structure comprises at least first, second, and third parts assembled to define first and second portions of the storage chamber, where first and second reference planes extending through the first and second portions, respectively, are offset from each other.

9. A vacuum cleaning system as recited in claim 8, in which at least one of the first and second portions is serpentine.

10. A vacuum cleaning system as recited in claim 8, in which a control system is configured to turn the vacuum assembly on when the hose end carrier enters the storage chamber inlet port and turn the vacuum assembly off when the hose end carrier reaches the storage chamber outlet.

11. A vacuum cleaning system as recited in claim 10, further comprising a door configured to open when the hose end carrier enters the storage chamber, where the control system turns the vacuum assembly on when the door opens.

12. A method of storing a hose member for a vacuum system comprising the steps of:
defining a storage chamber having a storage chamber inlet port, a storage chamber outlet operatively connected to the common chamber, and at least one turn portion;
providing a hose end carrier defining a carrier reference distance, where the carrier reference distance of the hose end carrier is slightly less than a chamber reference distance of the storage chamber; and
forming a hose assembly by securing the hose end carrier on the hose member such that the hose carrier is spaced from a proximal end of the hose member;
displacing the hose assembly along the storage chamber such that the hose end carrier pivots at the at least one turn portion of the storage chamber, and
the hose member reference distance of the hose member is sized and dimension with respect to the carrier reference distance to allow pivoting of the proximal end of the hose member such that the proximal end of the hose member passes through the at least one turn portion of the storage chamber.

13. A method as recited in claim 12, in which step of providing the hose storage structure comprises the steps of assembling at least first, second, and third parts to define first and second portions of the storage chamber, where the first and second portions vertically spaced from each other.

14. A method as recited in claim 13, in which at least one of the first and second portions is serpentine.

15. A method as recited in claim 12, further comprising the step of providing the carrier reference distance within a range of between 15% and 40% larger than the hose reference distance.

16. A method as recited in claim 12, further providing the step of providing the carrier reference distance within a range of between 15% and 150% larger than the hose reference distance.

17. A method as recited in claim 12, further comprising the steps of:
arranging a first sensor to generate a first signal when the hose end carrier enters the storage chamber inlet port,
arranging a second sensor to generate a second signal when the hose end carrier enters the storage chamber outlet,
the turning the vacuum assembly on when the first signal is generated; and
the turning the vacuum assembly off when the second signal is generated.

18. A method as recited in claim 17, further comprising the step of:
arranging a door to open when the hose end carrier enters the storage chamber; and
arranging the first sensor to generate the first signal when the door opens.

19. A method of storing a hose member for a vacuum system comprising the steps of:
defining a storage chamber having a storage chamber inlet port, a storage chamber outlet operatively connected to the common chamber, and at least one turn portion;
providing a hose end carrier defining a carrier reference distance, where
a carrier reference distance of the hose end carrier is slightly less than a chamber reference distance of the storage chamber, and
a hose member reference distance of the hose member is sized and dimension with respect to the carrier reference distance to facilitate movement of the hose member along the storage chamber;
forming a hose assembly by securing the hose end carrier on the hose member;
displacing the hose assembly along the storage chamber such that the hose end carrier pivots at the at least one turn portion of the storage chamber;
arranging a first sensor to generate a first signal when the hose end carrier enters the storage chamber inlet port,
arranging a second sensor to generate a second signal when the hose end carrier enters the storage chamber outlet,
the turning the vacuum assembly on when the first signal is generated; and
the turning the vacuum assembly off when the second signal is generated.

20. A method of storing a hose member for a vacuum system comprising the steps of:
defining a storage chamber having a storage chamber inlet port, a storage chamber outlet operatively connected to the common chamber, and at least one turn portion;
providing a hose end carrier defining a carrier reference distance, where
a carrier reference distance of the hose end carrier is slightly less than a chamber reference distance of the storage chamber, and
a hose member reference distance of the hose member is sized and dimension with respect to the carrier reference distance to facilitate movement of the hose member along the storage chamber;
forming a hose assembly by securing the hose end carrier on the hose member;
displacing the hose assembly along the storage chamber such that the hose end carrier pivots at the at least one turn portion of the storage chamber;

arranging a door to open when the hose end carrier enters the storage chamber; and arranging the first sensor to generate the first signal when the door opens.

* * * * *